US009103176B2

(12) United States Patent
Delmar et al.

(10) Patent No.: US 9,103,176 B2
(45) Date of Patent: Aug. 11, 2015

(54) INSTRUMENTED CORE BARREL APPARATUS AND ASSOCIATED METHODS

(75) Inventors: Ludovic Delmar, Braine l'alleud (BE); Will Bradford, Houston, TX (US); Ron Dirksen, Spring, TX (US); Lorne Rutherford, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 609 days.

(21) Appl. No.: 13/368,649

(22) Filed: Feb. 8, 2012

(65) Prior Publication Data

US 2013/0199847 A1 Aug. 8, 2013

(51) Int. Cl.

| | |
|---|---|
| ***E21B 25/00*** | (2006.01) |
| ***E21B 25/04*** | (2006.01) |
| ***E21B 49/08*** | (2006.01) |
| ***E21B 47/10*** | (2012.01) |

(52) U.S. Cl.

CPC ..... *E21B 25/00* (2013.01); *E21B 25/04* (2013.01); *E21B 47/10* (2013.01); *E21B 49/08* (2013.01)

(58) Field of Classification Search

CPC ..... E21B 25/00; E21B 49/10; E21B 49/08; E21B 49/081

USPC ..... 166/250.01, 264, 162; 175/59, 403, 44, 175/58, 244–255, 332, 333, 404–405.1

See application file for complete search history.

(56) References Cited

U.S. PATENT DOCUMENTS

| | | | | |
|---|---|---|---|---|
| 4,638,872 | A * | 1/1987 | Park et al. | 175/46 |
| 5,905,061 | A | 5/1999 | Patel | |
| 5,977,031 | A | 11/1999 | Patel | |
| 5,984,023 | A * | 11/1999 | Sharma et al. | 175/50 |
| 6,828,279 | B2 | 12/2004 | Patel et al. | |
| 7,191,831 | B2 * | 3/2007 | Reid et al. | 166/264 |
| 7,920,258 | B2 | 4/2011 | Myrick et al. | |
| 2006/0000603 | A1 * | 1/2006 | Zazovsky et al. | 166/244.1 |
| 2008/0066534 | A1 * | 3/2008 | Reid et al. | 73/152.11 |
| 2009/0078467 | A1 * | 3/2009 | Castillo | 175/249 |
| 2009/0126928 | A1 * | 5/2009 | Sumrall et al. | 166/250.01 |
| 2010/0224361 | A1 * | 9/2010 | Pope et al. | 166/250.02 |
| 2011/0247879 | A1 | 10/2011 | Johnston et al. | |
| 2012/0012392 | A1 * | 1/2012 | Kumar | 175/58 |
| 2012/0234607 | A1 * | 9/2012 | Kinsella | 175/403 |

FOREIGN PATENT DOCUMENTS

WO 2013119724 A2 8/2013

OTHER PUBLICATIONS

International Search Report and Written Opinion for PCT/US2013/025012 dated Jul. 4, 2014.

Official Action for Australian Patent Application No. 2013217124 dated May 29, 2015.

* cited by examiner

*Primary Examiner* — Blake Michener

*Assistant Examiner* — Steven MacDonald

(74) *Attorney, Agent, or Firm* — McDermott Will & Emery LLP; Alan Bryson

(57) ABSTRACT

A coring apparatus may be integrated with fluid analysis capabilities for in situ analysis of core samples from a subterranean formation. An instrumented coring apparatus may include an inner core barrel; an outer core barrel; a coring bit; and an instrumented core barrel having an analysis device in fluid communication with the inner core barrel.

35 Claims, 5 Drawing Sheets

INSTRUMENTED CORE BARREL APPARATUS AND ASSOCIATED METHODS

BACKGROUND

The present invention relates to a coring apparatus with integrated fluid analysis capabilities for in situ analysis of core samples from a subterranean formation.

In order to analyze core samples from a subterranean formation, a core apparatus drills a core sample. Once at the surface, the core sample is often preserved by hermetically sealing the core sample in a thick coating of wax or by freezing with dry ice. The purpose of preservation is primarily to maintain the core and any fluids therein and the distribution of those fluids in the core sample as close as possible to reservoir conditions. Additionally, effective preservation prevents changes in the rock, e.g., mineral oxidation and clay dehydration.

However, as the native pressure of the core sample is invariably much higher than the pressure at the surface, the gases and light fluids that may have been trapped in the rock will escape from the core sample as it is brought to the surface thus making the core sample less accurate in providing a picture of the subterranean formation from which the core sample was taken. Determining accurate gas volumes, content and deliverability, can be important when attempting to assess the economics of an unconventional gas play, e.g., gas hydrates and shales. These determinations rely heavily on the analysis of freshly cut core. The escaped gas, in effect, leaves a data gap, which can be accounted for with a theoretical model that may or may not approximate downhole conditions.

A method known as "pressure coring" attempts to mitigate the escape of pressurized gases by encapsulating the core in a pressure vessel downhole. Once the core is cut, the core chamber is sealed at reservoir pressure to prevent gases from escaping the vessel while bringing to the surface. At surface, the gas is extruded and analyzed on-site or in a laboratory. Pressure coring, however, can be difficult to implement with increased health and safety risks. Pressure coring requires specialized training to deal with the high pressure equipment to retrieve the core sample. Further, the containers are pressurized typically to several thousand psi, which introduces the risk of explosions. Also, if high levels of toxic gases, like $H_2S$, are collected, leaks could pose serious risks to health and life.

SUMMARY OF THE INVENTION

The present invention relates to a coring apparatus with integrated fluid analysis capabilities for in situ analysis of core samples from a subterranean formation.

In some embodiments, an instrumented coring apparatus may comprise an inner core barrel; an outer core barrel; a coring bit; and an instrumented core barrel comprising an analysis device in fluid communication with the inner core barrel.

In some embodiments, an instrumented core barrel may comprise an analysis device; a core barrel capable of operably attaching to a coring apparatus such that an inner barrel of the coring apparatus is in fluid communication with the analysis device; and a power source operably connected to the analysis device.

In some embodiments, a method may comprise collecting a core sample from a location in a subterranean formation using an instrumented coring apparatus, the instrumented coring apparatus comprising: an inner core barrel, an outer core barrel, a coring bit, and an instrumented core barrel comprising an analysis device in fluid communication with the inner core barrel; and analyzing fluid from the core sample with the analysis device while the coring apparatus is in the subterranean formation proximate to the location to produce analysis results.

In some embodiments, a method may comprise providing a fracturing fluid having a dictated composition, the dictated composition being informed by analysis results from an instrumented coring analysis method; and placing the fracturing fluid in a subterranean formation at a pressure sufficient to create or enhance at least one fracture therein.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

Figure 1:
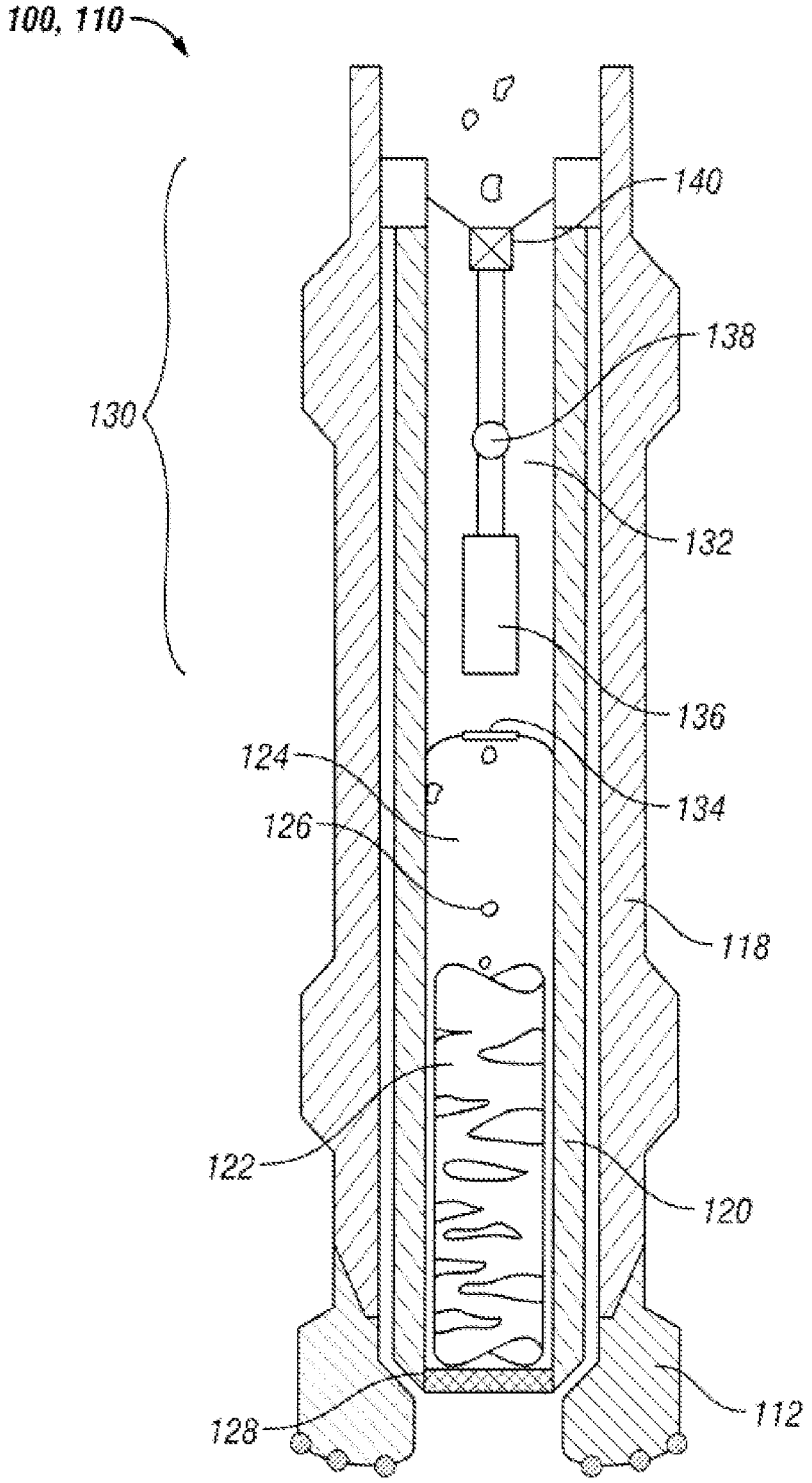
FIG. 1 provides an illustration of an instrumented coring apparatus according to a nonlimiting configuration of the present invention. (Not drawn to scale.)

The present invention relates to a coring apparatus with integrated fluid analysis capabilities for in situ analysis of core samples from a subterranean formation.

The present invention provides instrumented coring apparatuses that incorporate integrated fluid (e.g., liquid and/or gas) analysis capabilities, which allow for in situ analysis of a core sample and therefore the conditions of the surrounding subterranean formation. In situ analysis is especially useful in formations with high gas content, e.g., gas hydrates and shales. The instrumented coring apparatus provides for operators to use traditional coring procedures while vastly increasing their knowledge of the conditions and hydrocarbons contained downhole. Further, the instrumented coring apparatus does not increase the health and safety risks over traditional coring techniques, and may, at least in some embodiments, actually reduce the health and safety risks presented by more traditional coring techniques. Information related to the time, pressure, depth and temperature at which point fluids and/or gas escapes from the core can provide important data for single, or multiphase hydraulic flow models to estimate reservoir and wellbore productivity and ultimate recovery potential, as well as optimum conditions for well production, drawdown and stimulation.

In some embodiments of the present invention, an instrumented coring apparatus of the present invention may comprise, consist essentially of, or consist of an instrumented core barrel in fluid communication with a coring apparatus. In some embodiments of the present invention, an instrumented core barrel may be in fluid communication with an inner core barrel of a coring apparatus.

Suitable coring apparatuses for use in conjunction with the instrumented coring apparatus of the present invention may be any coring apparatus capable of extracting a core sample from a portion of a subterranean formation, including but not limited to, those capable of coring in the direction of the wellbore and/or those capable of coring at a direction deviated from the wellbore (e.g., those comprising sidewall core guns). Further, nonconventional coring apparatuses may be suitable, including, but not limited to, unconsolidating coring apparatuses, full closure coring apparatuses, sponge coring apparatuses, oriented coring apparatuses, and glider coring apparatuses. One skilled in the art, with the benefit of this disclosure, should understand the geometry of said core samples may vary with different coring apparatuses and procedures. By way of nonlimiting example, core samples may be cylindrical (including substantially cylindrical) samples with a length of a few inches to over 90 feet, e.g., about 5 feet to about 90 feet. Further, a single coring apparatus may collect more than one core sample of the same or different geometries.

In some instances, a coring apparatus may comprise an inner core barrel, an outer core barrel, and a coring bit. Oftentimes, in coring procedures, the inner core barrel retrieves the core sample from the subterranean formation.

Some embodiments of the present invention may involve collecting a core sample from a location in a subterranean formation with a coring apparatus that is in fluid communication with an instrumented coring barrel according to the present invention; and analyzing fluids (liquids and/or gases) released from the core sample in the instrumented core barrel. Some embodiments of the present invention may involve collecting a core sample from a location in a subterranean formation with a coring apparatus that is in fluid communication with an instrumented coring barrel according to the present invention; and analyzing fluids released from the core sample in the instrumented core barrel. In at least some preferred embodiments, analysis may occur while the instrumented coring apparatus is in the subterranean formation.

Some embodiments of the present invention may involve bringing the instrumented coring apparatus to the wellbore surface for retrieving a core sample. Some embodiments of the present invention may involve returning the instrumented coring apparatus to a different location in the subterranean formation and collecting another core sample, as shown in nonlimiting FIG. 5. In some embodiments of the present invention, the instrumented coring apparatus may be used to collect a plurality of core samples, e.g., 6 or more, from different locations in the subterranean formation.

In some embodiments, an instrumented core barrel may be an integral component of a coring apparatus. Referring to the nonlimiting example illustrated in FIG. 1, in some embodiments, instrumented core barrel 130 may be an integral component of inner core barrel 120 of coring apparatus 110, which because of integration is also instrumented coring apparatus 100. Coring apparatus 110 also includes outer core 118 and coring bit 112. Gas 126 from core sample 122 may collect in gas collection section 124. Gas collection section 124 may be in fluid communication with gas chamber and analysis section 132 via gas inlet 134. Analysis device 136 may analyze gas 126 in gas chamber and analysis section 132. Further, in some alternative embodiments, seal 128 may be set below core sample 122 to prevent gas 126 from escaping through the bottom of inner core barrel 120. Analysis device 136 may include battery pack 138 in some embodiments. To ensure gas chamber and analysis section 132 does not over pressurize, instrumented core barrel 130 may, in some embodiments, comprise valve 140, e.g., a check valve.

Figure 2:
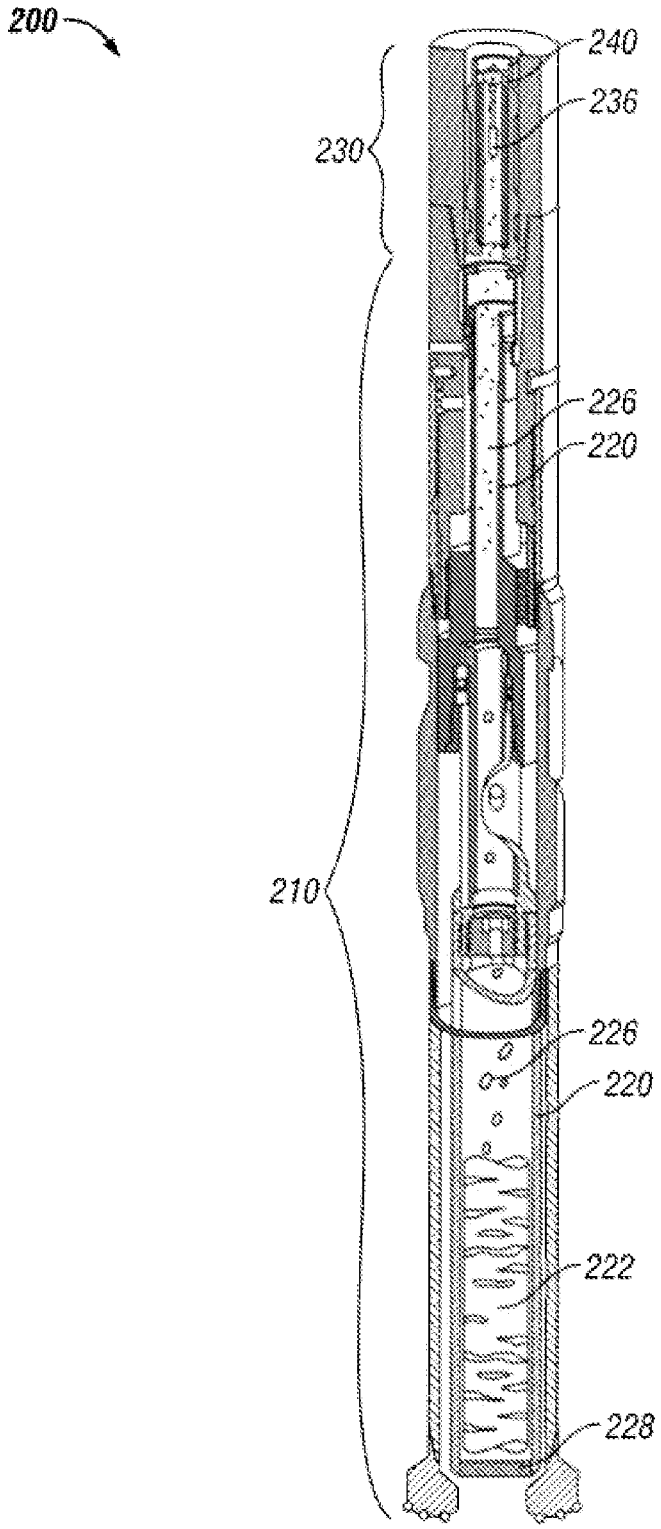
FIG. 2 provides an illustration of an instrumented coring apparatus according to a nonlimiting configuration of the present invention. (Not drawn to scale.)

Referring to the nonlimiting example illustrated in FIG. 2, in some embodiments, instrumented coring apparatus 200 may include instrumented core barrel 230 detachable from coring apparatus 210, but in fluid communication with coring apparatus 210. Gas 226 from core sample 222 in inner core barrel 220 may be in open fluid communication with analysis device 236. To prevent gas 226 from escaping via pathways not in fluid communication with analysis device 236, in some embodiments, inner core barrel 220 may comprise seal 228. Further, in some embodiments, instrumented core barrel 230 may comprise valve 240, e.g., a check valve, to ensure instrumented coring barrel 230 does not over pressurize.

Figure 3:
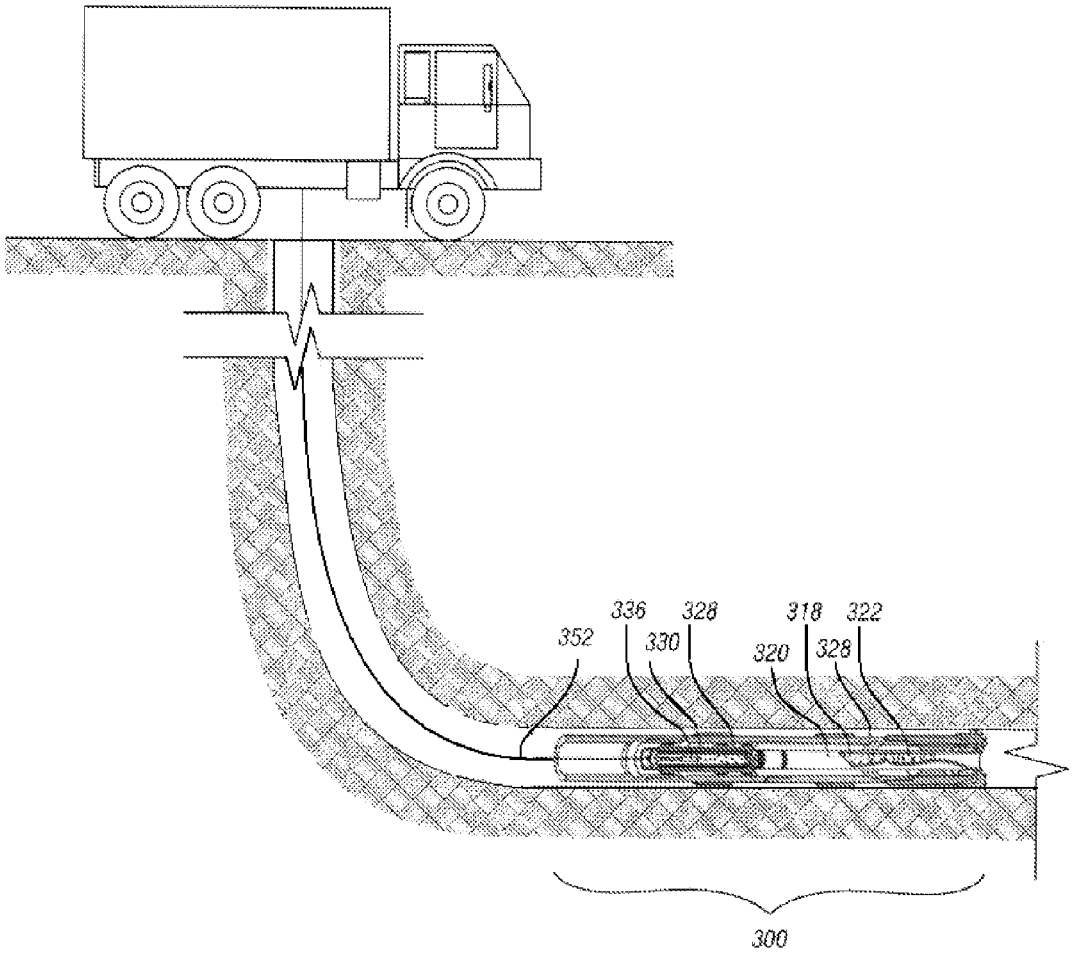
FIG. 3 provides an illustration of an instrumented coring apparatus in conjunction with a wireline according to a nonlimiting configuration of the present invention. (Not drawn to scale.)

Referring to the nonlimiting example illustrated in FIG. 3 of instrumented coring apparatus 300, in some embodiments, inner core barrel 320 operably attached to instrumented core barrel 330 may be fed into the wellbore, e.g., a horizontal wellbore as shown in FIG. 3, on wireline 352. Inner core barrel 320 operably attached to instrumented core barrel 330 may operably connect to outer core barrel 318 such that inner core barrel 320 may receive core sample 322 and gas 328 may be analyzed by analysis device 336. After receiving core sample 322, inner core barrel 320 operably attached to instrumented core barrel 330 may be guided to the surface by wireline 352. In some embodiments, core sample 322 may be removed from inner core barrel 320 and inner core barrel 320 operably attached to instrumented core barrel 330 may be fed back into the wellbore on wireline 352 to retrieve another core sample at a different location in the subterranean formation. In some embodiments, rather than sending the same inner core barrel 320 operably attached to instrumented core barrel 330, inner core barrel 320 may be replaced with another inner core barrel to retrieve another core sample. In some embodiments, both inner core barrel 320 and instrumented core barrel 330 may be replaced to retrieve another core sample.

The apparatuses and methods described herein may be suitable for use in wellbores having vertical to a horizontal orientations, e.g., vertical wellbores, deviated wellbores, highly deviated wellbores, and horizontal wellbores. As used herein, the term "deviated wellbore" refers to a wellbore that is at least about 30 to 60 degrees off-vertical (wherein 90-degrees off-vertical corresponds to a fully horizontal wellbore). As used herein, the term "highly deviated wellbore" refers to a wellbore that is at least about 60 to 90 degrees off-vertical (wherein 90-degrees off-vertical corresponds to a fully horizontal wellbore).

Figure 4A:
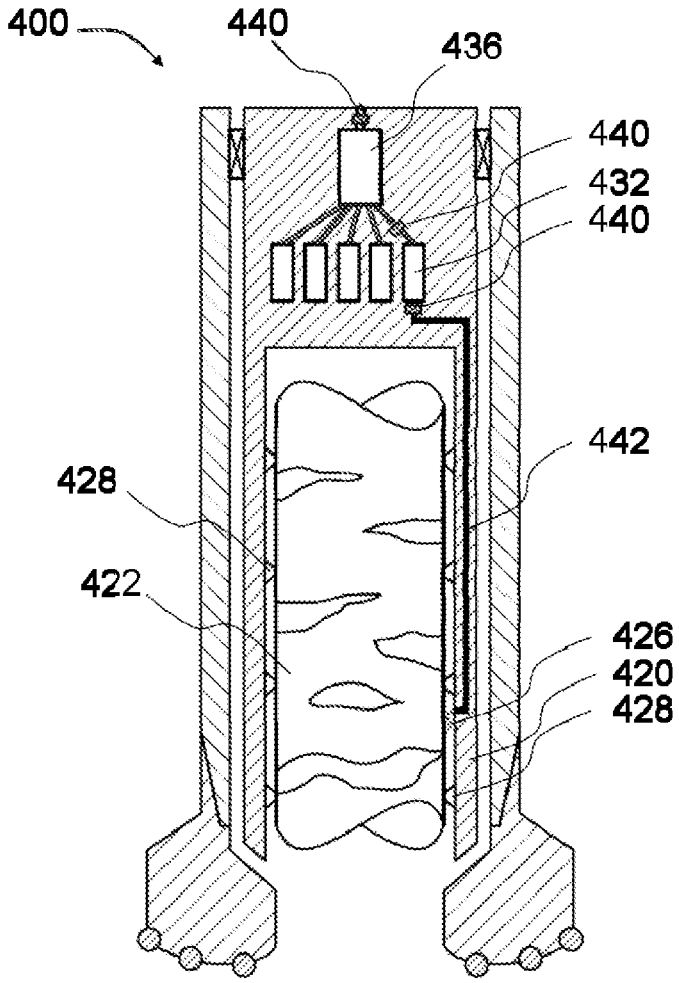
FIGS. 4A-B provide illustrations of an instrumented coring apparatus according to a nonlimiting configuration of the present invention. (Not drawn to scale.)
Figure 4B:
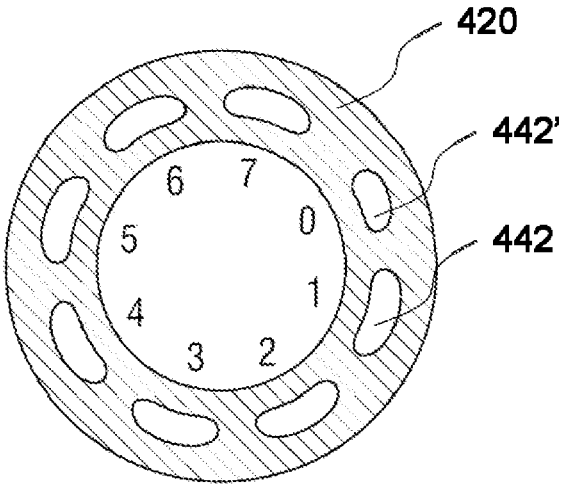

Referring to the nonlimiting example illustrated in FIGS. 4A-B, an analysis instrument may be in fluid communication with a portion of a core sample. Referring to FIG. 4A, instrumented coring apparatus 400 may comprise inner core barrel 420 having a plurality of seals 428 capable of engaging core sample 422 in more than one location along the length of core sample 422. Each isolated section of core sample 422 may be in fluid communication with analysis device 436 for analyzing gas and/or liquid 426 from different sections of core sample 422. Said fluid communication may be through passageway 442 and include gas chamber and analysis section 432. A plurality of valves 440 may be used for regulated fluid communication and/or controlled sampling. Referring to FIG. 4B, inner core barrel 420 may include passageway 442' of a different size and/or shape than other passageways 442 to assist with proper alignment.

In some embodiments, an instrumented coring apparatus and/or a coring apparatus may further comprise a driving motor operably connected to the coring bit, a drive shaft coupled to the drive motor, and a hydraulic pump coupled to the drive motor.

In some embodiments of the present invention, the instrumented coring apparatus may comprise a geo steering device and/or a geo stopping device, such as at, or near bit gamma-ray, resistivity, acoustic and other formation evaluation sensors, or vibration, or torque sensors that indicate changes in lithology.

In some embodiments of the present invention, analysis devices may be in fluid communication with the entire core sample or portions of the core sample.

In some embodiments of the present invention, fluid communication may be achieved with a tubing connection. In some embodiments of the present invention, a tubing connection may be between an inner core barrel and an analysis device and/or between an inner core barrel and a fluid chamber and analysis section. In some embodiments, fluid communication may be achieved with a passageway in the inner core barrel that extends from a location proximal to the core sample to the analysis device and/or a chamber in fluid communication with the analysis device.

In some embodiments of the present invention, a core sample may be in open fluid communication, i.e., no barriers or fluid flow control, with an analysis device. In some embodiments of the present invention, fluid communication between a core sample and an analysis device may be in regulated fluid communication.

Regulated fluid communication may be achieved with the placement of fluid flow control elements between a core sample and an analysis device. Regulated fluid communication may be on/off control for intermittent sampling and/or flow rate control for continuous sampling.

Suitable fluid flow control elements may include, but not be limited to, valves, gas flow controllers, gas flow meters, liquid flow controllers, liquid flow meters, or any combination thereof. Incorporated in such fluid flow control devices may be filters, semi-permeable separation devices, and/or osmotic-based separation devices. In some embodiments, fluid flow control elements may be electronically controlled. Suitable valves may include, but not be limited to, check valves, diaphragm valves, gate valves, needle valves, pneumatic valves, sampling valves, or any combination thereof. Such valves may be pressure and/or temperature controlled.

In some embodiments of the present invention, an instrumented core barrel may comprise fluid flow control elements to regulate fluid flow to the analysis device. By way of nonlimiting example, an instrumented core barrel may comprise a gas inlet to the analysis device with a sampling valve to control gas flow through the gas inlet.

In some embodiments of the present invention, regulated fluid communication between a core sample and an analysis device may regulate the pressure of the fluid proximal to the core sample and/or of the fluid proximal to the analysis device. By way of nonlimiting example, an instrumented core barrel may comprise a check valve to allow for a maximum pressure proximal to the analysis device.

Further, regulated fluid flow may be on/off control so as to isolate the analysis device from the fluid if said fluid may deleteriously effect the analysis device. In some embodiments, fluid communication may be open with on/off controls to isolate the analysis device from the fluid if said fluid may deleteriously effect the analysis device.

In some embodiments of the present invention, regulated fluid communication may involve a fluid collection section in fluid communication with a core sample separated by a fluid flow control element from a fluid chamber and analysis section that comprises analysis device or at least a fluid inlet to an analysis device.

In some embodiments of the present invention, fluid communication may involve sampling components that assist with transmitting fluid to and/or from analysis devices. Suitable sampling components may include, but not be limited to, pumps, vacuums, pistons, and the like, or any combination thereof. In some embodiments, sampling components may be operably attached to passageways, tubings, and the like through which fluids may flow. By way of nonlimiting example, a tubing may extend from a fluid collection section to the core and have a piston attached thereto such that the piston and tubing act like a syringe to assist in moving liquids from the core sample along the fluid communication path to the analysis device.

In some embodiments of the present invention, the coring apparatus may comprise seals capable of isolating at least a portion of the core sample in the inner core so as to prevent fluid flow beyond said seal, a nonlimiting example of which is shown in FIG. 4A. Seals may be at any point below and/or along the core sample including, but not limited to, below the core sample, proximal to the bottom of the core sample, proximal to the top of the core sample, proximal to the middle of the core sample, or any combination thereof. In some embodiments of the present invention, an inner core may have upper seals, intermediate seals, lower seals, or any combination thereof. It should be noted, that relational terms do not imply an operable directional orientation of the instrumented coring apparatus.

Suitable seals may comprise standard elastomeric materials, e.g., nitrile, fluoroelastomers, or VITON® (fluoroelastomers). Suitable seals may be in the form of inflatable packers or packing materials designed to react to and swell in certain fluids before activation. Suitable seals may be in the form of standard o-ring seals, t-seals, bladder seals, multicontact seals (e.g., rippled seals), and the like. Suitable seals may be ball valve seals. More than one type of seal may be used in a single instrumented coring apparatus.

In some embodiments of the present invention, the coring apparatus may comprise seals capable of isolating a plurality of core sample sections in the inner core so as to allow for analysis of individual sections. By way of nonlimiting example, core samples of about 9 meters (30 feet) to about 27.5 meters (90 feet) long may be retrieved by the inner core barrel and sealed off in about 1.5-meter (5-foot) sections. Said 1.5 meter (5-foot) sections may be sampled and analyzed individually. Further correlations between depth and the parameters analyzed may be conducted.

In some embodiments of the present invention, an inner core barrel may be fluted and/or perforated. Fluting and/or perforating may provide fluid communication paths, or at least a portion of a fluid communication path, between the core sample and the instrumented core barrel.

Suitable materials to form the inner core barrel may include, but not be limited to, steel, aluminum, fiberglass, or any combination thereof. One skilled in the art should understand that the inner core material should be chosen such that the material does not react with the fluids of the subterranean formation.

In some embodiments of the present invention, the inner core barrel may comprise a sponge layer. A sponge layer may assist in collecting liquids from the core sample, which may be advantageous for analysis when removed from the wellbore and/or for preventing liquids from traveling to the instrumented core barrel when gases are the desired fluid to be analyzed.

Some embodiments of the present invention may involve collecting a fluid sample from a core sample that can be analyzed at a later time. Suitable fluid sample storage elements may include, but not be limited to, bladders, fluid capture devices, ampoules, bottles, syringes, containers comprising a septa, or any combination thereof. In some embodiments of the present invention, fluid sample storage elements may be removable and/or disposable.

Figure 5:
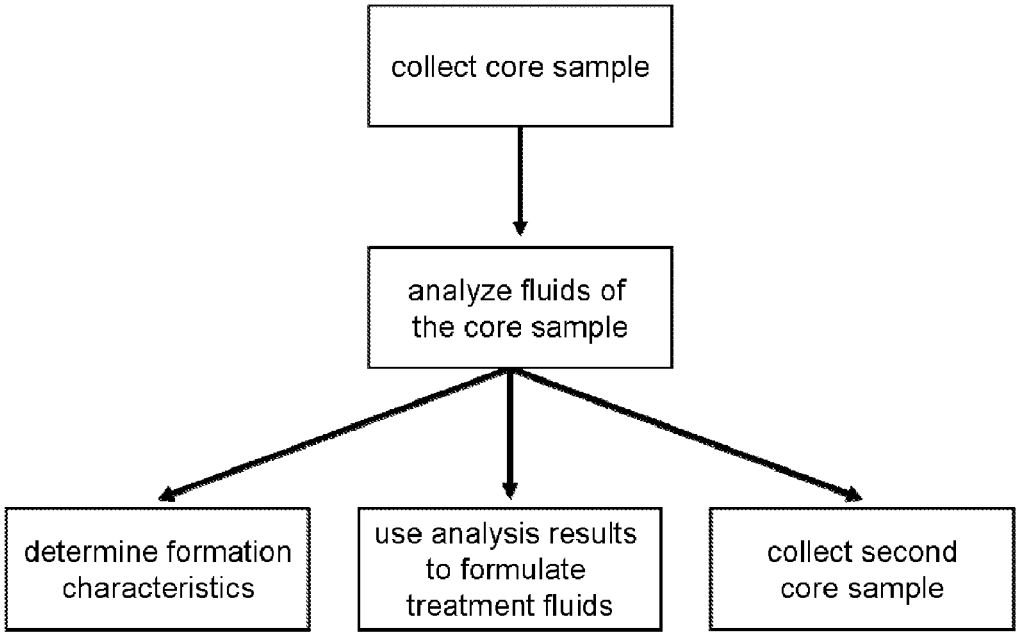
FIG. 5 provides a flow chart of methods according to nonlimiting embodiments of the present invention.

In some embodiments of the present invention, an analysis device may measure the properties of fluids from a core sample, as shown in nonlimiting FIG. 5. Suitable properties to analyze may include, but not be limited to, chemical composition, trace element composition and/or concentration, heavy metal composition and/or concentration, asphaltene composition and/or concentration, concentration of specific fluids, concentration of gases dissolved in liquids, gas to oil ratio, fluid pressure, fluid volume, temperature, radioactivity, viscosity, turbidity, salinity, pH, microorganism activity, or any combination thereof. Examples of gases that may be useful to analyze may include, but not be limited to, methane, ethane, hydrogen, carbon dioxide, hydrogen sulfide, hydrogen phosphide, water, radon, or any combination thereof. Examples of liquids that may be useful to analyze may include, but not be limited to, hydrocarbon fluids, oil, water, or any combination thereof.

Suitable analysis techniques for use in conjunction with some embodiments of the present invention may include, but not be limited to, gas chromatography, capillary gas chromatography, liquid chromatography, mass spectroscopy, light scattering, optical imaging, thermal imaging, UV spectroscopy, visible spectroscopy, near-infrared spectroscopy, infrared spectroscopy, Raman spectroscopy, fluorescence spectroscopy, radioactivity detection, rheometry, x-ray scattering, and the like, any hybrid thereof, or any combination thereof.

Suitable analysis devices may include, but not be limited to, chromatographic devices, camera devices, spectrometry devices, optical devices, pressure devices, temperature devices, radioactivity-detection devices, rheometers, pH meters, light scattering devices, x-ray diffraction devices, x-ray fluorescence devices, laser-induced breakdown spectroscopy devices, and the like, any hybrid thereof, or any combination thereof. A nonlimiting example of an optical device is an integrated computational element (ICE), which separates electromagnetic radiation related to the characteristic or analyte of interest from electromagnetic radiation related to other components of a sample. Further details regarding how the optical computing devices can separate and process electromagnetic radiation related to the characteristic or analyte of interest are described in U.S. Pat. No. 7,920,258, the entire disclosure of which is incorporated herein by reference.

In some embodiments of the present invention, an instrumented coring apparatus may comprise a combination of analysis devices. Said combination may synergistically analyze properties of fluids from the core sample. By way of nonlimiting example, a pressure device, a temperature device, and an optical device may be configured to correlate the composition of gases with the pressure and temperature. This may be advantageous to understanding and/or simulating the native structure/composition of the core sample. In some embodiments, said combination may be independently analyzing properties. Combinations of correlated and independent analysis may be suitable.

In some embodiments of the present invention, a power source may be operably connected to an analysis device. Suitable power sources may include, but not be limited to, batteries, supercapacitors, energy harvesting devices, electrical connections via a wireline, and the like, or any combination thereof. As used herein, the term "energy harvesting device" refers to a device capable of converting mechanical, thermal, and/or photon energy into electrical energy. Energy harvesting devices may or may not store at least a portion of the converted energy.

Given the spatial limitations of the instrumented core barrel, it may be advantageous to use surface-enhanced spectroscopy, micro- and/or nano-sensors, and/or micro- and/or nanochannel devices.

In some embodiments of the present invention, analysis devices may be capable of producing real-time data. In some embodiments of the present invention, data may be stored on an information storage device within the instrumented coring apparatus. In some embodiments of the present invention, e.g., when the instrumented coring apparatus is on a telecommunicative wireline, data may be transmitted to the wellbore surface in real-time, or at least substantially real-time. In some embodiments of the present invention, an instrumented coring apparatus may comprise a telemetry device capable of transmitting data to the wellbore while the instrumented coring apparatus is within the wellbore. Combinations of any of these data storage and/or transmission devices may be used. One skilled in the art, with the benefit of this disclosure, should understand the considerations necessary when employing data storage and/or transmission, e.g., depth within the subterranean formation, composition of the subterranean formation, volume of data to be stored and/or transmitted, and any combination thereof.

In some embodiments of the present invention, the data and/or analysis results from analysis devices may be used to determine characteristics of the formation, as shown in nonlimiting FIG. 5. In some embodiments of the present invention, the data and/or analysis results from analysis devices may be used in combination with data later collected from individual core samples to determine characteristics of the formation. Examples of formation characteristics may include, but not be limited to, the degree to which gases are adsorbed or absorbed, the formation porosity, the formation permeability, the fluid composition of the formation relative to depth, or any combination thereof.

In some embodiments of the present invention, an analysis device may be to a processor (e.g., a computer, an artificial neural network, and the like, or any hybrid thereof) configured for manipulating data and/or analyzing data obtained from an analysis device. By way of nonlimiting example, a computer may receive data from a plurality of analysis devices and correlate said data.

In some embodiments of the present invention, an instrumented core barrel may comprise a processor programmed to cause an action based on the data and/or analysis results obtained from an analysis device. By way of nonlimiting example, an instrumented core barrel may comprise a computer programmed to close a valve that isolates the analysis device from the gas from the core sample when the concentration of a specific gas reaches a specific level. Another nonlimiting example may include an instrumented core barrel comprising a computer programmed to open and/or seal a fluid sample storage element when liquid having turbidity above a specific level is detected by the analysis device. Said liquid sample may then be analyzed at a later time, e.g., at the wellbore and/or in a laboratory. Another nonlimiting example may include an instrumented core barrel comprising a computer capable of processing data from analysis devices to determine the total volume of gas from the core sample and the composition thereof.

Some embodiments of the present invention may involve formulating a treatment fluid based on the data and/or analysis results from the instrumented coring barrel. Suitable treatment fluids may include, but not be limited to, stimulation fluids, fracturing fluids, completion fluids, drilling fluids, and/or cement compositions. In some embodiments, the composition of the treatment fluid may be dictated by the data and/or analysis results from the instrumented coring barrel. Suitable compositional changes may include, but not be limited to, the types and concentration of additives and/or the base fluid composition. By way of nonlimiting example, analysis results may show that at a first depth the subterranean formation has a high water content and at a second depth the subterranean formation has a low water content. Given these analysis results, treatment fluids and/or treatment operations may be developed to limit fluid extraction from the first depth and maximize fluid extraction from the second depth, e.g., a first treatment fluid for treating the first depth may include higher concentrations of plugging agents than a second treatment fluid for treating the second depth. By way of another nonlimiting example, analysis results may show a subterranean formation with, in order of increasing depth, a first zone having natural gas dissolved in water, a second zone having high asphaltene concentrations, and a third zone having hydrocarbons with high levels of sulfur and other corrosive compounds. Given these analysis results, treatment fluids and/or treatment operations may be tailored to appropriately treat each zone to maximize extraction of the fluids of interest.

Examples of additives may include, but not be limited to salts, weighting agents, inert solids, plugging agents, bridging agents, fluid loss control agents, emulsifiers, dispersion aids, corrosion inhibitors, emulsion thinners, emulsion thickeners, viscosifying agents, gelling agents, surfactants, particulates, proppants, lost circulation materials, foaming agents, gases, pH control additives, breakers, biocides, crosslinkers, stabilizers, chelating agents, scale inhibitors, mutual solvents, oxidizers, reducers, friction reducers, clay stabilizing agents, or any combination thereof.

Suitable base fluids may include, but not be limited to, oil-based fluids, aqueous-based fluids, aqueous-miscible fluids, water-in-oil emulsions, or oil-in-water emulsions. Suitable oil-based fluids may include alkanes, olefins, aromatic organic compounds, cyclic alkanes, paraffins, diesel fluids, mineral oils, desulfurized hydrogenated kerosenes, and any combination thereof. Suitable aqueous-based fluids may include fresh water, saltwater (e.g., water containing one or more salts dissolved therein), brine (e.g., saturated salt water), seawater, and any combination thereof. Suitable aqueous-miscible fluids may include, but not be limited to, alcohols, e.g., methanol, ethanol, n-propanol, isopropanol, n-butanol, sec-butanol, isobutanol, and t-butanol; glycerins; glycols, e.g., polyglycols, propylene glycol, and ethylene glycol; polyglycol amines; polyols; any derivative thereof; any in combination with salts, e.g., sodium chloride, calcium chloride, calcium bromide, zinc bromide, potassium carbonate, sodium formate, potassium formate, cesium formate, sodium acetate, potassium acetate, calcium acetate, ammonium acetate, ammonium chloride, ammonium bromide, sodium nitrate, potassium nitrate, ammonium nitrate, ammonium sulfate, calcium nitrate, sodium carbonate, and potassium carbonate; any in combination with an aqueous-based fluid, and any combination thereof. Suitable water-in-oil emulsions, also known as invert emulsions, may have an oil-to-water ratio from a lower limit of greater than about 50:50, 55:45, 60:40, 65:35, 70:30, 75:25, or 80:20 to an upper limit of less than about 100:0, 95:5, 90:10, 85:15, 80:20, 75:25, 70:30, or 65:35 by volume in the base treatment fluid, where the amount may range from any lower limit to any upper limit and encompass any subset therebetween. Examples of suitable invert emulsions include those disclosed in U.S. Pat. No. 5,905,061, U.S. Pat. No. 5,977,031, and U.S. Pat. No. 6,828,279, each of which are incorporated herein by reference. It should be noted that for water-in-oil and oil-in-water emulsions, any mixture of the above may be used including the water being and/or comprising an aqueous-miscible fluid.

In some embodiments, the treatment fluid with the dictated composition may be introduced into a subterranean formation with parameters known to one skilled in the art. By way of nonlimiting example, a fracturing fluid may be placed into a subterranean formation at a pressure sufficient to create or enhance at least one fracture in the subterranean formation.

In some embodiments, an instrumented coring apparatus may generally include an inner core barrel, an outer core barrel, a coring bit, and an instrumented core barrel comprising an analysis device in fluid communication with the inner core barrel.

In some embodiments, an instrumented core barrel may generally include an analysis device, a core barrel capable of operably attaching to a coring apparatus such that an inner barrel of the coring apparatus is in fluid communication with the analysis device, and a power source operably connected to the analysis device.

In some embodiments, a method may generally include collecting a core sample from a location in a subterranean formation using an instrumented coring apparatus and analyzing fluid from the core sample with the analysis device while the coring apparatus is in the subterranean formation proximate to the location to produce analysis results. The instrumented coring apparatus may generally include an inner core barrel, an outer core barrel, a coring bit, and an instrumented core barrel comprising an analysis device in fluid communication with the inner core barrel.

In some embodiments, a method may generally include providing a fracturing fluid having a dictated composition, the dictated composition being informed by analysis results from an instrumented coring analysis method; and placing the fracturing fluid in a subterranean formation at a pressure sufficient to create or enhance at least one fracture therein.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. An instrumented coring apparatus comprising:

an inner core barrel configured to retrieve and contain a core sample;

an outer core barrel;

a coring bit;

an instrumented core barrel comprising an analysis device in fluid communication with the inner core barrel for receiving a gas released from the core sample contained in the inner core barrel; and a plurality of seals axially spaced along a length of the inner core barrel and configured to engage the core sample contained in the inner barrel to create a plurality of isolated sections of the core sample along a length of the inner core barrel where each of the isolated sections of the core sample are independently in fluid communication with the analysis device.

2. The instrumented coring apparatus of claim 1, wherein the instrumented core barrel further comprises a fluid chamber and analysis section in fluid communication with the inner core barrel and the analysis device.

3. The instrumented coring apparatus of claim 2, wherein the inner core barrel and the fluid chamber and analysis section are connected by a tubing connection.

4. The instrumented coring apparatus of claim 3 further comprising:

a fluid flow control element capable of controlling fluid communication between the analysis device and the inner core barrel.

5. The instrumented coring apparatus of claim 4, wherein the fluid flow control element comprises at least one selected from the group consisting of: a valve, a gas flow controller, a liquid flow controller, and any combination thereof.

6. The instrumented coring apparatus of claim 1, wherein fluid communication is regulated fluid communication.

7. The instrumented coring apparatus of claim 1, wherein the analysis device is selected from the group consisting of a chromatographic device, camera device, a spectrometry device, an optical device, a pressure device, a temperature device, a radioactivity-detection device, a rheometer, a pH meter, a light scattering device, an x-ray diffraction device, an x-ray fluorescence device, a laser-induced breakdown spectroscopy device, and any combination thereof.

8. The instrumented coring apparatus of claim 1, wherein the analysis device is capable of performing at least one analysis technique selected from the group consisting of gas chromatography, capillary gas chromatography, liquid chromatography, mass spectroscopy, light scattering, optical imaging, thermal imaging, UV spectroscopy, visible spectroscopy, near-infrared spectroscopy, infrared spectroscopy, Raman spectroscopy, fluorescence spectroscopy, radioactivity detection, rheometry, x-ray scattering, and any combination thereof.

9. The instrumented coring apparatus of claim 1, wherein the inner core barrel is fluted and/or perforated.

10. The instrumented coring apparatus of claim 1, wherein the inner core barrel comprises a material selected from the group consisting of:

steel, aluminum, fiberglass, and combinations thereof.

11. The instrumented coring apparatus of claim 1, wherein the instrumented core barrel further comprises a check valve.

12. The instrumented coring apparatus of claim 1, wherein the inner core barrel and the analysis device are connected by a tubing connection.

13. The instrumented coring apparatus of claim 1, wherein the instrumented core barrel further comprises at least one selected from the group consisting of: a bladder, a fluid capture device, an ampoule, a bottle, a container comprising a septa, and any combination thereof.

14. The instrumented coring apparatus of claim 1 further comprising a connection point capable of operably connecting the core barrel to a wireline.

15. The instrumented coring apparatus of claim 1 further comprising:

a telemetry device.

16. The instrumented coring apparatus of claim 1 further comprising a geo steering device and/or a geo stopping device.

17. An instrumented core barrel comprising:

an analysis device;

a core barrel capable of operably attaching to a coring apparatus such that an inner barrel of the coring apparatus is in fluid communication with the analysis device; and a plurality of seals axially spaced along a length of the inner core barrel and configured to engage a core sample contained in the inner barrel to create a plurality of isolated sections of the core sample along a length of the inner core barrel where each of the isolated sections of the core sample are independently in fluid communication with the analysis device.

18. The instrumented core barrel of claim 17, wherein fluid communication is regulated fluid communication.

19. The instrumented core barrel of claim 17 further comprising:

a fluid chamber and analysis section in fluid communication with the analysis device.

20. The instrumented core barrel of claim 17 further comprising:

at least one selected from the group consisting of: a bladder, a fluid capture device, an ampoule, a bottle, a container comprising a septa, and any combination thereof.

21. The instrumented core barrel of claim 17 further comprising:

a check valve.

22. The instrumented core barrel of claim 17, wherein the analysis device is selected from the group consisting of a chromatographic device, camera device, a spectrometry device, an optical device, a pressure device, a temperature device, a radioactivity-detection device, a rheometer, a pH meter, a light scattering device, an x-ray diffraction device, an x-ray fluorescence device, a laser-induced breakdown spectroscopy device, and any combination thereof.

23. The instrumented core barrel of claim 17, wherein the analysis device is capable of performing at least one analysis technique selected from the group consisting of gas chromatography, capillary gas chromatography, liquid chromatography, mass spectroscopy, light scattering, optical imaging, thermal imaging, UV spectroscopy, visible spectroscopy, near-infrared spectroscopy, infrared spectroscopy, Raman spectroscopy, fluorescence spectroscopy, radioactivity detection, rheometry, x-ray scattering, and any combination thereof.

24. The instrumented core barrel of claim 17 further comprising:

a connection point capable of operably connecting the core barrel to a wireline.

25. The instrumented core barrel of claim 19 further comprising:

a telemetry device.

26. A method comprising:

collecting a core sample from a location in a subterranean formation using an instrumented coring apparatus, the instrumented coring apparatus comprising:

an inner core barrel, an outer core barrel, a coring bit, an instrumented core barrel comprising an analysis device in fluid communication with the inner core barrel for receiving a gas released from the core sample contained in the inner core barrel, and a plurality of seals axially spaced along a length of the inner core barrel and configured to engage the core sample contained in the inner barrel to create a plurality of isolated sections of the core sample along a length of the inner core barrel where each of the isolated sections of the core sample are independently in fluid communication with the analysis device;

engaging at least one seal with the core sample along a length of the core sample to define a section of the core sample and isolate the section to be in fluid communication with the analysis device; and analyzing a fluid released from the section of the core sample with the analysis device while the coring apparatus is in the subterranean formation.

27. The method of claim 26, wherein the analysis device is selected from the group consisting of a chromatographic device, camera device, a spectrometry device, an optical device, a pressure device, a temperature device, a radioactivity-detection device, a rheometer, a pH meter, a light scattering device, an x-ray diffraction device, an x-ray fluorescence device, a laser-induced breakdown spectroscopy device, and any combination thereof.

28. The method of claim 26, wherein the analysis device is capable of performing at least one analysis technique selected from the group consisting of gas chromatography, capillary gas chromatography, liquid chromatography, mass spectroscopy, light scattering, optical imaging, thermal imaging, UV spectroscopy, visible spectroscopy, near-infrared spectroscopy, infrared spectroscopy, Raman spectroscopy, fluorescence spectroscopy, radioactivity detection, rheometry, x-ray scattering, and any combination thereof.

29. The method of claim 26, wherein the step of analyzing involves measuring a property of the fluid, the property being at least one selected from the group consisting of: chemical composition, concentration of specific fluids, concentration of gases dissolved in liquids, fluid pressure, fluid volume, temperature, radioactivity, viscosity, turbidity, salinity, pH, microorganism activity, and any combination thereof.

30. The method of claim 26 further comprising:

determining formation characteristics at least partially based on the analysis results.

31. The method of claim 30, wherein the formation characteristic are selected from the group consisting of: a degree to which gases are adsorbed or absorbed, formation porosity, formation permeability, fluid composition of the formation relative to depth, and any combination thereof.

32. The method of claim 26 further comprising using the analysis results to formulate a stimulation fluid, a fracturing fluid, a completion fluid, a drilling fluid, or a cement composition.

33. The method of claim 26 further comprising:

collecting a second core sample from a second location in the subterranean formation.

34. The method of claim 33 further comprising:

analyzing fluid from the second core sample with the analysis device while the coring apparatus is in the subterranean formation proximate to the second location to produce second analysis results.

35. The method of claim 34 further comprising:

using the second analysis results to determine data as a function of depth and/or time.

* * * * *